US007553126B2

(12) United States Patent
Charier et al.

(10) Patent No.: US 7,553,126 B2
(45) Date of Patent: Jun. 30, 2009

(54) DEVICE FOR VARYING THE SECTION OF THE THROAT IN A TURBINE NOZZLE

(75) Inventors: Gilles Alain Marie Charier, La Grande Paroisse (FR); Claude Daniel Nottin, Saint-Sauveur S/Ecole (FR); Stephane Rousselin, Hericy (FR)

(73) Assignee: Snecma, Paris (FR)

( * ) Notice: Subject to any disclaimer, the term of this patent is extended or adjusted under 35 U.S.C. 154(b) by 577 days.

(21) Appl. No.: 11/355,884

(22) Filed: Feb. 17, 2006

(65) Prior Publication Data

US 2006/0188369 A1 Aug. 24, 2006

(30) Foreign Application Priority Data

Feb. 22, 2005 (FR) ..... 05 01768

(51) Int. Cl.
*F01D 9/00* (2006.01)

(52) U.S. Cl. ..... 415/128; 415/191

(58) Field of Classification Search ..... 415/134, 415/191, 211.2, 136–139, 159–162, 166, 415/48, 135, 170.1, 174.2, 173.3, 128; 60/796, 60/800, 752

See application file for complete search history.

(56) References Cited

U.S. PATENT DOCUMENTS 2,914,300 A * 11/1959 Sayre ..... 415/135
3,966,353 A * 6/1976 Booher et al. ..... 415/115
4,768,924 A * 9/1988 Carrier et al. ..... 415/189
5,301,500 A 4/1994 Hines
5,931,636 A 8/1999 Savage et al.
2006/0188368 A1 * 8/2006 Jinnai et al. ..... 415/191

FOREIGN PATENT DOCUMENTS

FR 2 708 311 2/1995

* cited by examiner

*Primary Examiner*—Richard Edgar
(74) *Attorney, Agent, or Firm*—Oblon, Spivak, McClelland, Maier & Neustadt, P.C.

(57) ABSTRACT

A device for varying the section of the throat of a turbine nozzle, the nozzle being formed by a plurality of stationary vanes extending radially between outer and inner annular platforms and spaced apart from one another in order to define a throat presenting a minimum flow section. The device comprises an annular element having a coefficient of expansion that is less than that of the platforms of the nozzle, the annular element being secured to the outer platform and being capable of taking up two positions: one position corresponding to no expansion of the platforms, in which the element provides continuity for the profile of the flow passage; and another position corresponding to the platforms having expanded, in which position the element projects into the flow passage so as to reduce its section.

13 Claims, 2 Drawing Sheets

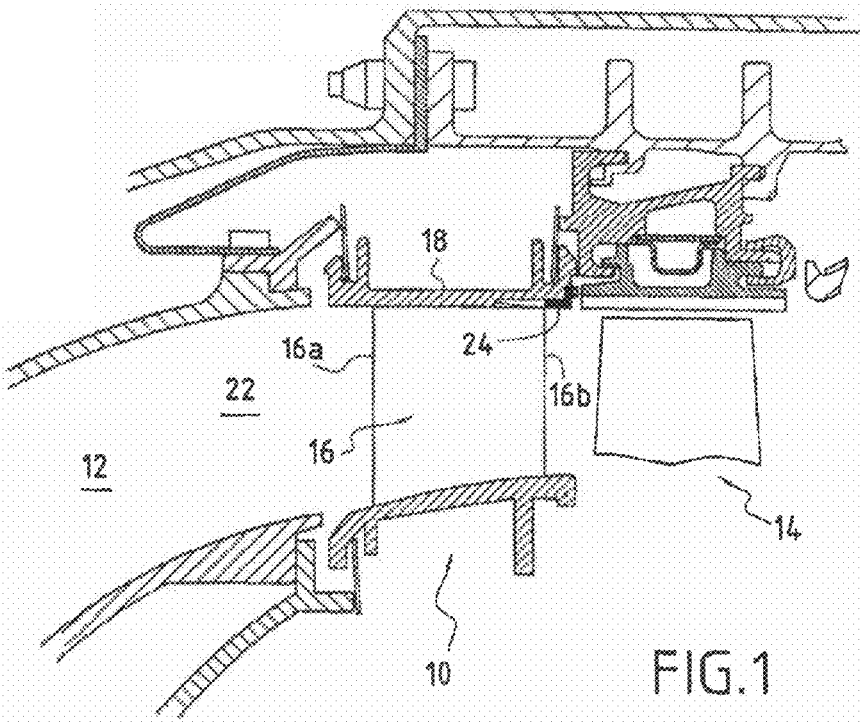
FIG.1
FIG.4A
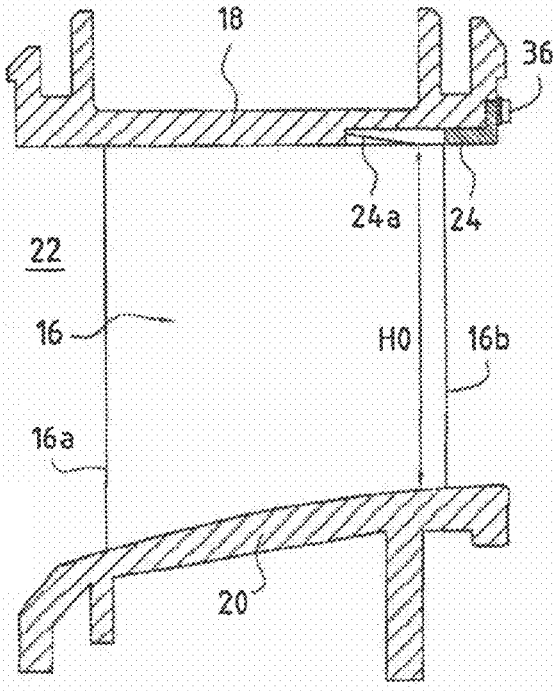
FIG.4B
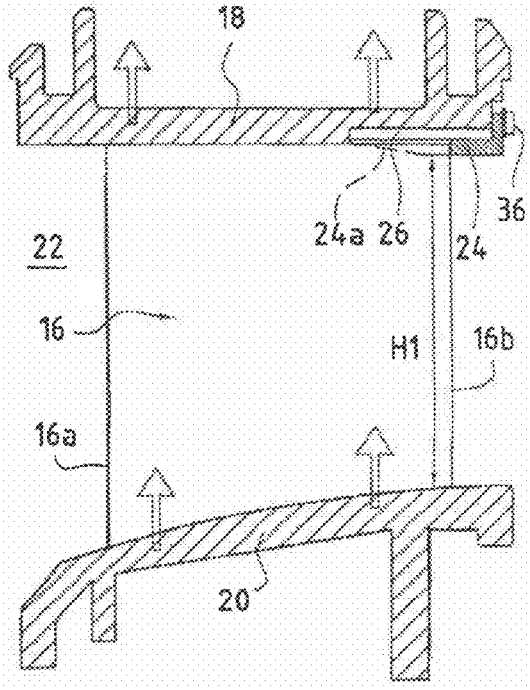

DEVICE FOR VARYING THE SECTION OF THE THROAT IN A TURBINE NOZZLE

BACKGROUND OF THE INVENTION

The present invention relates to the general field of turbine nozzles. It relates more particularly to a device enabling the section of the throat in a turbine nozzle to be varied.

In order to obtain increased thrust from a turbomachine, it is known to make use of variation in the gas flow section in the smallest-section portion, known as the throat, of a high-pressure or a low-pressure turbine nozzle. The purpose of varying the section of a nozzle throat is to adapt the flow rate of the gas passing through the nozzle as a function of different stages in the operation of the turbomachine. In particular, it is necessary to be able to enlarge the section of the nozzle throat while the turbomachine is idling, while otherwise reducing the section in order to increase the pumping margin and reduce the specific consumption of the turbomachine.

In known devices, throat section is varied by means of hinged systems. Thus, systems are known having flaps provided on the walls of the gas flow passage between the stationary vanes of the nozzle, in the vicinity of its throat. These flaps are hinged by means of pivots, cranks, and a control ring, and they can thus provide a step in the gas flow passage in order to reduce its section. Hinged vane systems are also known in which all or some of the vanes can pivot in the gas flow passage in order to reduce its section. Such systems likewise require pivots and other hinged parts.

Those various known devices present the drawback of relying on hinging parts that are small in size. Because of the very hot environment in the nozzle zone, this runs the risk of the hinges seizing, burning, and suffering accelerated erosion. In addition, such devices rely on assembly and maintenance that are difficult to perform and expensive.

OBJECT AND SUMMARY OF THE INVENTION

A main object of the present invention is thus to mitigate such drawbacks by proposing a device for varying the throat section of a nozzle, the device requiring few parts, being easy to assemble, and being reliable in the hot environment of the nozzle.

To this end, the invention provides a device for varying the section of the throat of a turbine nozzle, the nozzle being made up of a plurality of stationary vanes extending radially between outer and inner annular platforms spaced apart from each other so as to define a flow passage for combustion gas passing through the turbine, the vanes being spaced apart from one another in order to define a throat presenting a minimum flow section, the device comprising an annular element having a coefficient of expansion that is less than that of the platforms of the nozzle, said annular element being secured to the outer platform and being suitable for occupying two positions: one position corresponding to no expansion of the platforms in which the element provides continuity for the profile of the flow passage, and another position corresponding to the platforms being expanded, in which position the element projects into the flow passage in such a manner as to reduce its section.

The presence of an annular element having a coefficient of expansion that is less than that of the platforms of the nozzle serves to take advantage of the difference in nozzle platform temperature between stages in which the turbomachine is idling and the other stages of machine operation in which the platforms expand. As a result, the proposed device comprises very few parts and does not rely on any hinges, thus providing advantages in assembly, maintenance, and reliability.

In a particular disposition of the invention, the annular element is held axially in an annular groove of the outer platform of the nozzle in the absence of the nozzle platforms expanding, and is suitable for moving radially relative to the nozzle in the event of the platforms expanding.

In another particular disposition of the invention, the annular element includes at least one radial tab that is received in a notch in the outer platform so as to prevent the annular element from becoming eccentric relative to said outer platform. Under such circumstances, the device advantageously includes at least one member for holding the tab of the annular element axially relative to the outer platform.

In yet another particular disposition of the invention, the annular element presents an upstream portion of right section that tapers from downstream to upstream. When the platforms of the nozzle expand, this characteristic serves to avoid the annular element forming too sudden a step in the flow passage, since that would have the consequence of reducing the performance of the nozzle.

The annular element may be made of a composite material. Alternatively, it can be obtained using a ceramic material.

The present invention also provides a turbine nozzle including an above-defined device for varying the section of its throat.

BRIEF DESCRIPTION OF THE DRAWINGS

Other characteristics and advantages of the present invention appear from the following description made with reference to the accompanying drawings which show an embodiment having no limiting character. In the figures:

FIG. 1 is a fragmentary longitudinal section view of a turbomachine showing the location of the device of the invention;

FIGS. 4A and 4B show the device of the invention in its two operating positions.

DETAILED DESCRIPTION OF AN EMBODIMENT

Figure 2:
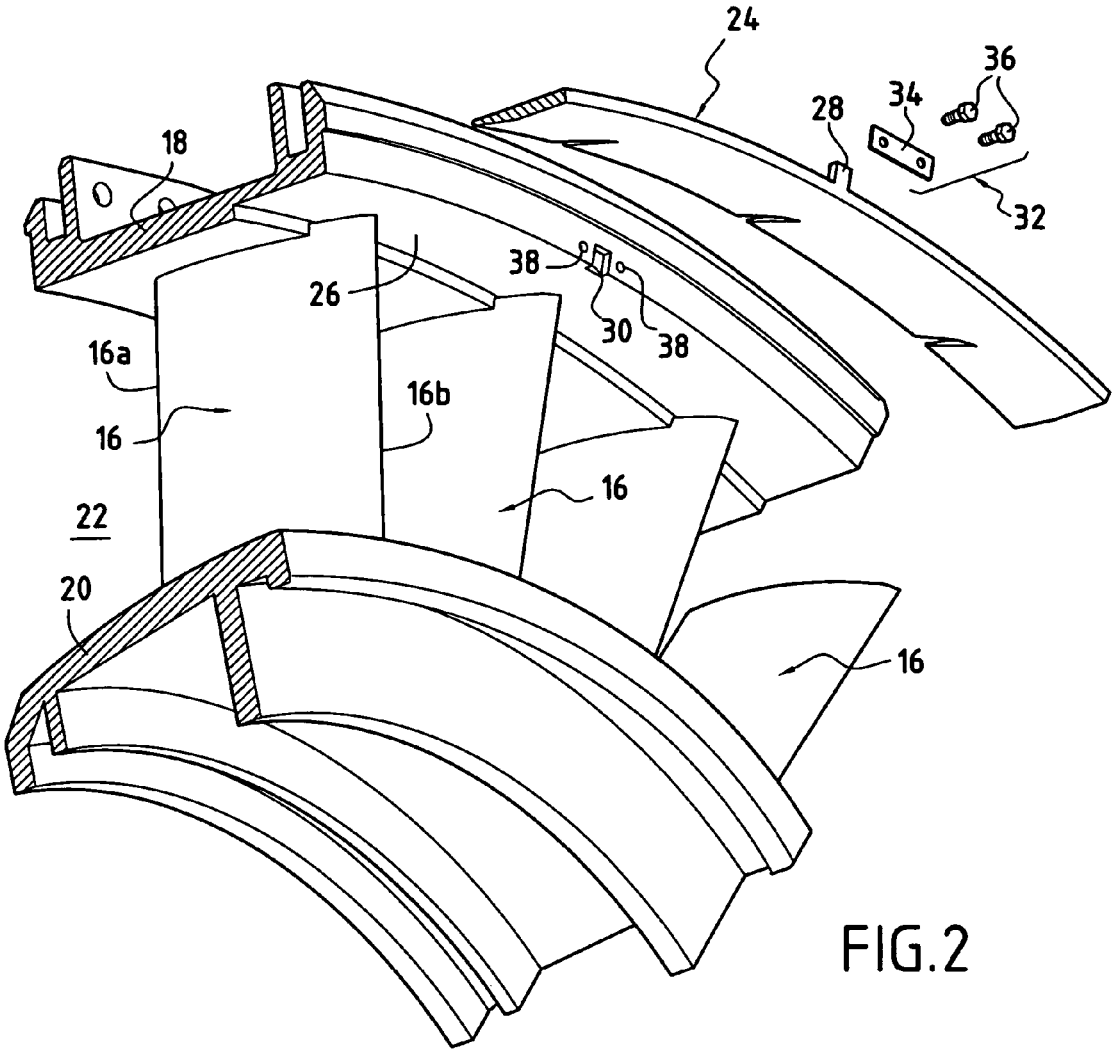
FIG. 2 is a fragmentary and exploded perspective view of a nozzle fitted with a device of the invention.

With reference to FIG. 1, a high-pressure nozzle 10 is mounted at the outlet from the combustion chamber 12 of a turbomachine, upstream from the high-pressure turbine 14 of the machine.

Naturally, the present invention can also be applied to a low-pressure nozzle in such a turbomachine.

The high-pressure nozzle 10 is made up of a plurality of stationary (or stator) vanes 16 extending radially between outer and inner annular platforms 18 and 20.

The platforms 18 and 20 are radially spaced apart from each other and are disposed concentrically about an axis of the turbomachine (not shown). The term "outer" platform is used to mean the platform that is furthest away from the axis of the turbomachine.

The platforms are typically made of metal. They may be each in the form of a single ring, or they may be built up from pluralities or ring segments placed end to end, and between them they define an annular passage 22 through which the gas from the combustion chamber 12 flows.

The vanes 16 of the nozzle are secured to the platforms 18, 20, between which they extend radially. They also extend axially from upstream to downstream between a leading edge 16*a* and a trailing edge 16*b*.

Figure 3:
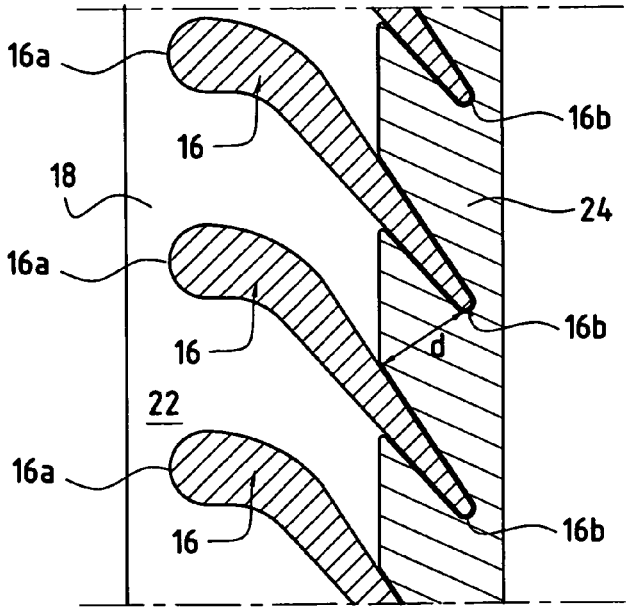
FIG. 3 is a view showing the FIG. 2 nozzle when developed flat.

The vanes 16 are also spaced apart from one another in the circumferential direction so as to define a throat presenting a minimum flow section. The throat of the nozzle is thus the portion of the passage 22 in which the flow section is the smallest. As shown in FIG. 3, this section is defined by the shortest distance d between the trailing edge 16*b* of a vane 16 and the convex surface of the adjacent vane.

According to the invention, the nozzle as defined in this way is provided with a device for varying the section of its throat, which device comprises in particular an annular element 24 that possesses a coefficient of expansion that is smaller than that of the platforms 18 and 20 of the nozzle.

By way of example, the annular element 24 is made of a ceramic or a composite material. These materials have the particular property of presenting a coefficient of expansion that is practically zero, and thus necessarily less than that of the metal from which the platforms 18 and 20 of the nozzle are made.

Naturally, any other material presenting a coefficient of expansion smaller than that of the nozzle platforms could be used for making the annular element of the device of the invention for varying the section of the throat.

The annular element 24 is a single ring that is secured to the outer platform 18 of the nozzle. It is arranged to be capable of taking up two positions: one position corresponding to no expansion of the platforms, in which it provides a continuous profile for the flow passage 22, and another position corresponding to the platforms 18, 20 in an expanded configuration, in which case the ring projects into the flow passage, thereby reducing its section.

More precisely, the annular element 24 is received in an annular groove 26 formed in the outer platform 18 of the nozzle, in the downstream portion thereof. The annular groove 26 of the outer platform 18 presents a depth (radial extent) that is substantially identical to the thickness of the annular element 24 such that in the absence of expansion of the platforms 18, 20, the annular element ensures a continuous profile for the flow passage 22.

As shown in FIG. 3, the annular element 24 extends tangentially over the entire circumference of the outer platform 18 of the nozzle, and axially over substantially the entire length of the nozzle throat. To this end, it presents cutouts that match the shapes of the vanes 16, while nevertheless leaving small amounts of space relative thereto (not shown in FIG. 3) in order to accommodate possible expansion of the vanes.

In FIG. 2, it can be seen that the annular element 24 is also provided with one or more tabs 28 that extend radially outwards. Each tab 28 (there are preferably three tabs distributed uniformly around the circumference of the annular element) can be received in one or more corresponding notches 30 formed in the downstream edge of the outer platform 18 of the nozzle.

Each tab 28 of the annular element is associated with an axial holder member 32 for holding it to the outer platform 18 of the nozzle. This holder member 32 may be formed by a plate 34 provided with fastener pins 36 (e.g. two pins per plate) inserted in holes 38 formed in the outer platform 18. The plate 34 as held in place in this way by the pins 36 prevents the annular element 24 from moving axially relative to the outer platform 18.

The way in which the annular element 24 is mounted on the outer platform 18 of the nozzle can be seen clearly from the above description. Once all of the platform segments of the nozzle have been assembled, the annular element 24 is put into place in the groove 26 of the outer platform 18 and its tabs 28 are received in the notches 30 provided for this purpose. The annular element 24 is then secured axially by means of the plates 34 that are held in position by their pins 36. The tabs 28 thus serve to prevent the annular element from occupying a position that is eccentric relative to the axis of the turbomachine.

By means of such a disposition, it can be seen that the annular element 24 is held axially, but that radial displacement between the annular element and the outer platform 18 is possible in the radial direction. This radial relative displacement between the parts takes place when the platforms 18, 20 of the nozzle expand while operating in the manner described below with reference to FIGS. 4A and 4B.

FIG. 4A shows the nozzle when there is no expansion of the platforms 18 and 20. This state corresponds, for example, to the turbomachine idling.

FIG. 4B shows the same nozzle with its platforms expanded. This state corresponds to operating states of the turbomachine other than idling (e.g. full throttle).

In the position corresponding to the turbomachine idling (FIG. 4A), the temperature of the combustion gas flowing along the flow passages 22 (of the order of about 750 kelvins (K)) is not high enough to cause the outer and inner platforms 18 and 20 of the nozzle to expand. The annular element 24 then remains masked in the groove 26 of the outer platform 18. It reconstitutes a portion of the flow passage 22 and therefore does not interfere with the stream of gas flowing along said passage. The height of the passage 22 in the throat section of the nozzle is represented by dimension H0.

In the position corresponding to other operating states of the turbomachine (FIG. 4B), the outer and inner platforms 18 and 20 of the nozzle, which are made of metal, tend to expand under the effect of the high temperature given off by the combustion gas flowing in the flow passage 22 (temperature of the order of about 1400 K). The expansion of the platforms, which is a phenomenon that is known in the field of turbomachine nozzles, is represented by arrows in FIG. 4B.

In contrast, given that the annular element 24 possesses a coefficient of expansion that is less than that of the platforms, it expands little or not at all (and in any event less than the platforms). Since the annular element 24 is free to move radially relative to the outer platform 18, the annular element 24 then projects into the flow passage 22, thereby reducing the section of the nozzle throat. In this state, the height of the passage 22 in the throat of the nozzle, as represented by dimension H1, is less than H0.

According to an advantageous characteristic of the invention, in an upstream portion 24*a*, the annular element 24 presents a right section that tapers going from downstream to upstream. This characteristic which can be seen more clearly in FIGS. 4A and 4B, serves to avoid the annular element forming too sudden a step in the flow passage in the event of the nozzle platforms expanding, where such a step would have the consequence of reducing the performance of the nozzle.

The present invention thus takes advantage of the known phenomenon of expansion in a nozzle between the various stages of operation of the turbomachine in order to vary the section of the nozzle throat. The extent to which the throat section is reduced when the turbomachine is operating in a stage other than idling can be of the order of 4%, for example, with this value depending on the type of turbine on which the throat section-varying device is mounted.

The present invention presents numerous advantages. It operates in a manner that is extremely simple and reliable since it relies solely on the phenomenon of nozzle expansion. In addition, the throat section-varying device comprises very few parts and does not rely on any hinge, thereby making it easier to assemble and maintain and thus reducing its cost.

Other variants can be added to the embodiment described above. In particular, it is possible to envisage controlling the variation in throat section as a function of the different stages of operation of the turbomachine, other than idling. For this purpose, it is possible, for example, to provide an air flow rate controller to control the rate at which air cools the outer platform of the nozzle so as to reduce its expansion and thus limit the relative displacement between said platform and the annular element of the device.

What is claimed is:

1. A device for varying a section of a throat of a turbine nozzle, the nozzle being made up of a plurality of stationary vanes extending radially between outer and inner annular platforms spaced apart from each other so as to define a flow passage for combustion gas passing through the turbine, the vanes being spaced apart from one another in order to define a throat presenting a minimum flow section, the device comprising an annular element having a coefficient of expansion that is less than that of the platforms of the nozzle, said annular element being secured to the outer platform and movable relative to said outer platform so as to occupy two positions: one position corresponding to no expansion of the platforms in which the element provides continuity for the profile of the flow passage, and another position corresponding to the platforms being expanded, in which position the annular element projects into the flow passage in such a manner as to reduce its section.

2. A device according to claim 1, wherein the annular element is held axially in an annular groove of the outer platform of the nozzle in the absence of the nozzle platforms expanding, and is configured to move radially relative to the nozzle in the event of the platforms expanding.

3. A device according to claim 1, wherein the annular element includes at least one radial tab that is received in a notch in the outer platform so as to prevent the annular element from becoming eccentric relative to said outer platform.

4. A device according to claim 3, further including at least one member for axially retaining the tab of the annular element relative to the outer platform.

5. A device according to claim 1, wherein the annular element presents an upstream portion of right section that tapers from downstream to upstream.

6. A device according to claim 1, wherein the annular element extends axially over the entire length of the nozzle throat, wherein the nozzle throat is defined by a shortest distance between a trailing edge of a vane and a convex surface of an adjacent vane.

7. A device according to claim 1, wherein the annular element is made of a composite material.

8. A device according to claim 7, wherein the outer and inner platforms are made of metal.

9. A device according to claim 1, wherein the annular element is made of a ceramic material.

10. A device according to claim 9, wherein the outer and inner platforms are made of metal.

11. A turbine nozzle mounted at an outlet of a combustion chamber of a turbomachine and upstream from a turbine, said turbine nozzle including a device according to claim 1 for varying the section of its throat.

12. A device according to claim 1, wherein said annular element is connected to said outer platform such that said annular element is prevented from moving axially relative to said outer platform and such that said annular element is free to move radially relative to said outer platform so as to move between said two positions.

13. A device for varying a section of a throat of a turbine nozzle, the nozzle being made up of a plurality of stationary vanes extending radially between outer and inner annular platforms spaced apart from each other so as to define a flow passage for combustion gas passing through the turbine, the vanes being spaced apart from one another in order to define a throat presenting a minimum flow section, the device comprising an annular element having a coefficient of expansion that is less than that of the platforms of the nozzle, said annular element being secured to the outer platform and configured to occupy two positions provides continuity for the profile of the flow passage, and another position corresponding to the platforms being expanded, in which position the annular element projects into the flow passage in such a manner as to reduce its section, wherein the annular element includes at least one radial tab that is received in a notch in the outer platform so as to prevent the annular element from becoming eccentric relative to said outer platform.

* * * * *